US005126173A

United States Patent [19]

Machenaud

[11] Patent Number: 5,126,173

[45] Date of Patent: Jun. 30, 1992

[54] METHOD AND APPARATUS FOR MIXING AND SPRAYING A HARDENER AND A HARDENABLE LIQUID

[76] Inventor: Jean-Philippe Machenaud, Prosign S.A., 72, rue Jean Bonal, 92250 La Garenne-Colombes, France

[21] Appl. No.: 422,638

[22] Filed: Oct. 17, 1989

[30] Foreign Application Priority Data

Oct. 18, 1988 [FR] France ..... 88 014215

[51] Int. Cl.[5] ..... B05D 1/34

[52] U.S. Cl. ..... 427/426; 118/302; 118/703

[58] Field of Search ..... 427/426; 118/703, 300, 118/302, 696, 699

[56] References Cited

U.S. PATENT DOCUMENTS

| | | | |
|---|---|---|---|
| 3,450,092 | 6/1969 | Kock | 118/703 |
| 4,403,736 | 9/1983 | Scharfenberg | 118/302 |
| 4,745,011 | 5/1988 | Fukuta et al. | 427/426 |
| 4,809,909 | 3/1989 | Kukesh | 239/1 |
| 4,962,724 | 10/1990 | Prus et al. | 118/302 |

*Primary Examiner*—Jay H. Woo

*Assistant Examiner*—Jeremiah F. Durkin, II

*Attorney, Agent, or Firm*—Kerkam, Stowell, Kondracki & Clarke

[57] ABSTRACT

The invention relates to a method and apparatus for bringing together a mixture comprising a basic liquid product and a hardener with a view to attaining a fast-hardening product for spraying a surface characterized in that upon the interruption of the spraying, a circuit for adjusted delay is activated for a period of time between a zero value and a value at least slightly less than the hardening time of the hardener when air-sealed. At the end of the predetermined period of time delay, with the aid of this delay circuit, a signal is emitted, the signal is operatively applied to circuits to cause the feeding of the base and hardener (2) to the mixer to be interrupted while an evacuation and cleaning cycle is triggered. This cycle includes, in particular, alternating phases of washing, using at least one solvent, and rinsing. During the cleaning cycle, the hardener is returned to its reservoir by way of a recirculation circuit. The invention is applicable to the engineering industry, and in particular to equipment for marking roadways.

11 Claims, 1 Drawing Sheet

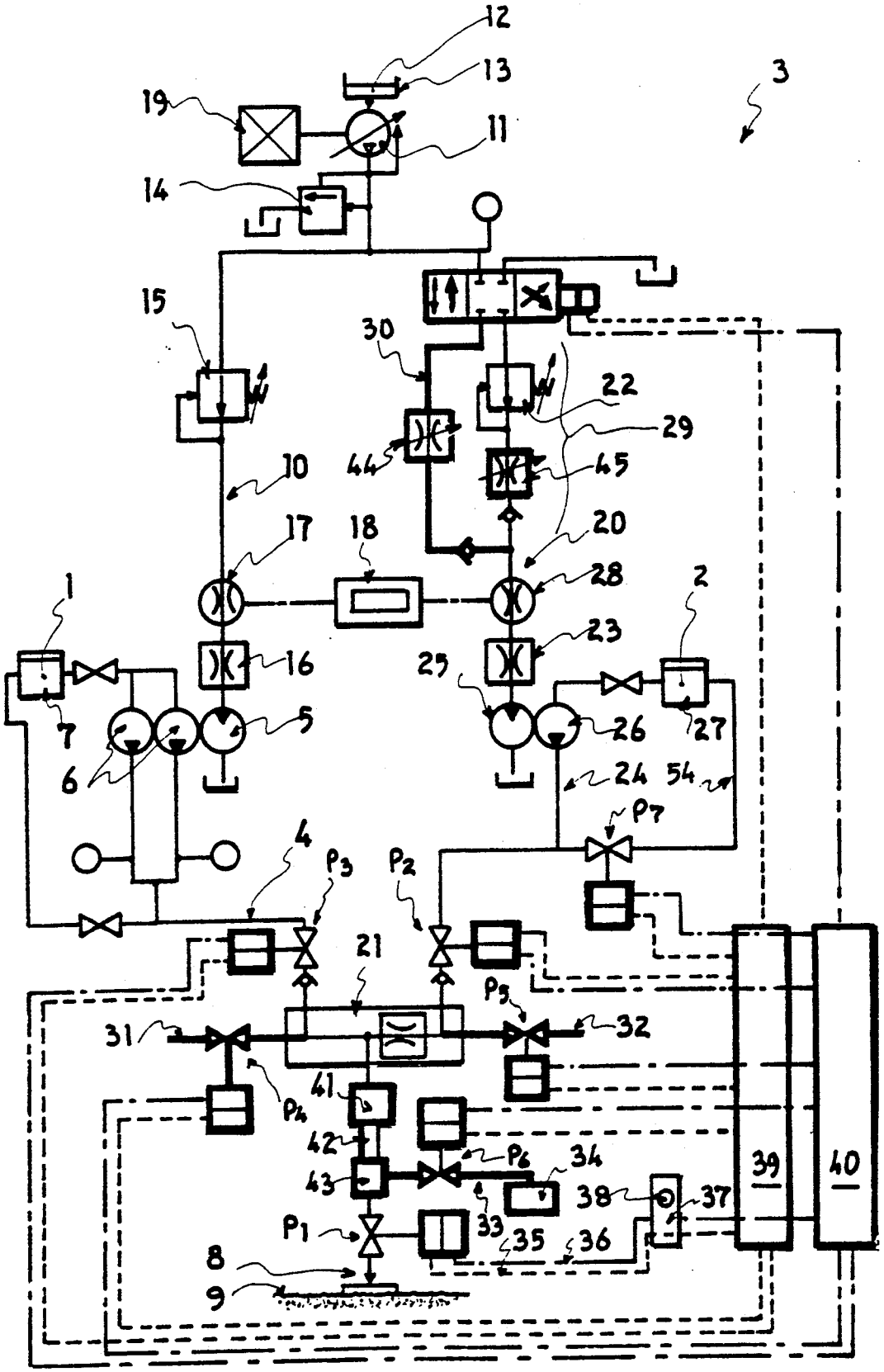
12
13
3
19
11
14
15
30
22
29
44
45
10
17
18
20
28
1
2
16
23
25
7
5
26
27
6
24
54
P7
4
P3
P2
21
P5
31
32
41
P4
42
P6
34
43
38
37
39
40
P1
33
35
36
8
9

METHOD AND APPARATUS FOR MIXING AND SPRAYING A HARDENER AND A HARDENABLE LIQUID

BACKGROUND OF THE INVENTION

The invention relates to a method for bringing together a basic liquid product and a hardener, with a view to attaining a fast-hardening product.

It also relates to means for performing the method and to the equipment provided with these means.

More particularly, but not exclusively, it applies to the field of applying marks to the ground, particularly for marking roadways.

In this field, methods of distributing paint are known, particularly with the aid of a "airless" circuit, which mainly includes a motor that drives at least one pump that forces the paint contained in a reservoir onto the ground, via a circuit leading to a spray nozzle.

The motor that drives the paint pump may be of any known type, and may for example comprise a hydraulic motor, supplied with a hydraulic circuit including a pump of variable output that takes oil from a reservoir and carries it to the hydraulic motor, after passage first via a connection with a safety valve and then via a pressure reducer/regulator and optionally an output reducer that prevents racing of the motor and/or a flow meter that is for example connected to a computer in order to determine the painting output as a function of the ratio of the two circuits.

The oil pump in turn is driven by any known means, particularly a diesel engine.

The assembly including these means is generally mounted on the chassis of a vehicle.

The characteristics of the nozzle and its height from the ground determine the width to which the paint is deposited.

The output of the nozzle and the forward speed of the vehicle, in turn, determine the thickness of the layer of paint deposited.

By interrupting the output of the nozzle, which is done with the aid of a controlled valve placed upstream of the nozzle, the limits of the marks to be made are determined.

Besides the nozzle that sprays the paint, the vehicle generally includes a distributor for fillers such as retro-reflective ballotini and/or sand.

So that traffic will be interrupted for as brief a time as possible, the paint must dry very rapidly, and to this end it is known to make use of a hardener.

Until now, this hardener has been in the form of a powder distributed in the manner of the fillers, or even jointly with them.

Hence it only reaches the surface of the layer of paint.

This method of bringing together the basic product and the hardener does not permit uniform mixing and hence does not permit uniform drying of the paint.

Furthermore, it spoils the colors that the paint comes in.

For bringing together two basic liquid products, equipment is known (European Patent 45 536) that in addition to the main circuit includes a secondary circuit with a secondary pump that forces the second liquid product contained in a secondary reservoir along the secondary circuit.

The main circuit and the secondary circuit both lead to the same mixer that supplies the spray nozzle.

In order that the proportions of the mixture to be made are adhered to, the two pumps clearly must have accordingly adjusted outputs, and the actions of the hydraulic circuits are synchronized.

They may also be supplied by the same hydraulic pump.

However, this equipment is unsuitable for bringing together a liquid product and a liquid hardener in order to attain a product that hardens fast enough for painting roads, for example hardening in one minute in the open air at 20° C. or in 30 seconds when air-sealed.

In fact, the mixed product would clearly have enough time to solidify in the mixer during breaks in the spraying, which would make this mixer unusable.

Furthermore, the proportions of hardener with respect to the base are quite low, for example being only 1-2%, and so the output of the hardener circuit would be low, and its low speed and the constancy of pressure that the pump would communicate to the hardener would rapidly cause the liquid and solid portions to separate, rendering this hardener unusable.

One object that the invention seeks to obtain is a method for bringing together a base and a hardener that assures a uniform mixture of the product obtained and that does not affect the colors that the product comes in.

Another object that the invention seeks to obtain is a method that assures that the distributor means cannot become clogged and that the hardener will remain usable for a very long time.

To this end, the subject of the invention is a method of the aforementioned type, by which method the secondary reservoir is supplied with the liquid hardener that the secondary product circuit brings to the mixer, which mixes it with the base prior to carrying the mixture to the spray nozzle, and upon completion of the spraying, the feeding of both the base and the hardener to the mixer is interrupted, and an evacuation and cleaning cycle is triggered, during which evacuation and cleaning cycle the return of the hardener to its reservoir is controlled in such a way as to recirculate it, this method being characterized in particular in that:

upon the interruption of the spraying, a circuit for adjusted delay is activated for a period of time between a zero value and a value at least slightly less than the hardening time when air-sealed;

and the end of the predetermined period of time, with the aid of this delay circuit, a signal is emitted, with the aid of which:

the feeding of the base (1) and hardener to the mixer is interrupted, and the evacuation and cleaning cycle is triggered, including, in particular, alternating phases of washing, using at least one solvent, and rinsing, during which cleaning cycle the aforementioned return of the hardener to its reservoir is controlled in such a way as to recirculate it.

The subject is also the means for performing this method and the equipment provided with these means.

BRIEF DESCRIPTION OF THE DRAWING

The invention will be better understood with the aid of the ensuing description, given by way of non-limiting example, taken in conjunction with the accompanying drawing, which schematically shows equipment provided with the means for performing the invention.

DESCRIPTION OF THE PREFERRED EMBODIMENT

Turning now to the drawing, it can be seen that for bringing together a basic liquid product, such as a paint, and a hardener 2, the equipment 3 mainly includes a circuit 4 for the base with a motor 5, in particular, driving at least one pump 6 forcing the base 1 contained in a reservoir 7 into this circuit 4 leading to a nozzle 8 for spraying onto the ground 9.

Upstream of the nozzle 8, a valve $P_1$ is provided, controlled by circuits 35, 36 and permitting the interruption of the spraying.

The motor 5 driving the basic pump 4 for example comprises a hydraulic motor supplied by a hydraulic circuit 10 that includes its hydraulic pump 11 of variable output, which takes the oil 12 in a reservoir 13 and carries it to the hydraulic motor 5 after passage via a connection to a safety valve 14 and then via a pressure reducer 15 and optionally an output reducer 16, preventing racing of the motor, and/or a flow meter 17, for example connected to a computer microprocessor 18.

The oil pump is driven in turn by a motor 19, for example a diesel engine.

The assembly including these means is generally mounted on a vehicle chassis (not shown).

Besides the spray nozzle 8, the equipment may, as is conventional, include at least one distributor (not shown) for fillers such as retroreflective ballotini and/or sand.

The equipment may also include a circuit 24 for the secondary product, with a secondary pump 26 controlled by a secondary motor 25 forcing the second product, contained in a secondary reservoir 27, along the circuit 24 of the secondary product.

The circuit 4 of the main product and the circuit 24 of the secondary product both lead to the same mixer 21, which supplies the spray nozzle 8 under the control of the controlled valve $P_1$.

Clearly, the two pumps 6, 26 thus have outputs that are adjusted so as to adhere to the proportions of the mixture to be made, and the action of the main hydraulic circuit 10 is synchronized with that of a secondary hydraulic circuit 20.

This secondary hydraulic circuit 20, in the example of the main hydraulic circuit 10, passes via a pressure reducer 22 and even via an output reducer 23, preventing racing of the motor 25, and/or a flow meter 28.

These two hydraulic circuits 10, 20 are supplied for example by the same variable-output pump 11 and are placed under the control of the same safety valve 14.

In order to bring together the base and the hardener 2:

- the secondary reservoir 27 is supplied with the liquid hardener 2 that the secondary product circuit 24 carries to the mixer 21, which mixes it with the base 1 prior to it carrying the mixture to the spray nozzle 8;
- at the end of the predetermined period of time, with the aid of this delay circuit, a signal is emitted, with the aid of which:
- the feeding of the base 1 and hardener 2 to the mixer 21 is interrupted, and
- the evacuation and cleaning cycle is triggered, including, in particular, alternating washing phases, using at least one solvent, and rinsing phases, during which cleaning cycle the aforementioned return of the hardener to its reservoir is controlled in such a way as to recirculate it.

During the cleaning cycle, to avoid keeping the hardener under pressure, the return of the hardener upstream of the mixer to its reservoir is commanded, in order to recirculate it.

During the recirculation, the output of the secondary product circuit 24 need not be maintained in the proportions with respect to the output of the primary circuit that are necessary for the mixture, so to speed up the circulation of the hardener and hence the recirculation; in another feature of the invention, the movement of the motor 25 controlling the secondary pump 26 that assures the circulation of the hardener is speeded up.

To this end, over a portion 29 of the secondary hydraulic circuit 20, a shunt 30 is made, and over at least one of the sections that forms this shunt 30 and the portion 29 of the circuit bypassed by this shunt, the output is adjusted in such a way that in the shunt 30, the output is smaller than in the portion 29 of the circuit 20 bypassed by this shunt 30, and at the moment of recirculation the hydraulic flow of the secondary circuit is made to pass along the shunt, while during the mixing the flow of the hydraulic circuit is made to pass via the portion 29 of the secondary circuit that was bypassed by the shunt.

In a preferred embodiment, the presence of the base and hardener is monitored at the top of the mixer, and if at least one of the two is absent, feeding to the top of the mixer is prevented.

Advantageously, during the cleaning cycle, phases of dilution with the solvent are provided.

Similarly, a phase of air drying under pressure is provided.

In order to perform the method according to the invention, in addition to the controlled valve $P_1$ which is provided at the outlet of the mixer 21 just upstream of the nozzle 8, the equipment also includes:

- controlled valves $P_2$, $P_3$ at the arrival at the inlet to the mixer 21 of the circuits 4 of the base 1 and 24 of the hardener;
- circuits 31, 32 for feeding the products used in the various phases of the cleaning cycle, which circuits 31, 32 communicate at the top of the mixer 21, downstream of the controlled valves $P_2$, $P_3$ of the circuits 4 and 24 of the base 1 and hardener 2;
- controlled valves $P_4$, $P_5$ monitoring the arrival at the top of the mixer of the cleaning products via their circuits 31, 32;
- connected to the outlet of the mixer, upstream of the controlled valve $P_1$ monitoring the spraying, a circuit 33 for evacuation of the products contained in the mixer, which leads to a reservoir 34 for collecting these products, such as the mixtures of solvent and hardener;
- a controlled valve $P_6$ monitoring the evacuation to the reservoir 34 of the products contained in the mixer via their circuit 33;
- connected to the circuits 35, 36 for controlling the valve $P_1$ monitoring the spraying, a delay circuit 37 that on the one hand is provided with a means 38 for adjustment between a zero period of time and a period of time at least slightly shorter than that necessary for hardening of the mixture in an air-sealed manner and on the other hand emits a signal at the end of this period of time;
- a circuit 39, 40 which upon reception of this signal controls the closing of the controlled valves $P_2$, $P_3$ for arrival of the base 1 and hardener 2 in the mixer and triggers a cycle of evacuation and cleaning, including alternating phases of washing with at least one solvent and rinsing.

Preferably, the equipment also includes:

a recirculation conduit 54 for the hardener 2, connected to the circuit 24 of the hardener 2 upstream of the controlled valve $P_2$ monitoring the arrival of the hardener 2 at the mixer 21, which recirculation conduit 54 returns to the secondary reservoir 27 of the hardener;

interposed on this recirculation conduit 54, a controlled valve $P_7$ monitoring the return of the hardener 2 to its reservoir 27.

Advantageously, in order to speed up recirculation of the hardener, a shunt 30 is provided over a portion 29 of the secondary hydraulic circuit 20, and an output regulator 44, 45 is interposed over at least one of the sections which forms this shunt 30 and the portion 29 of the circuit bypassed by this shunt, such that in the shunt 30, the output will be less than in the portion 29 of the circuit 20 bypassed by this shunt 30, and a distributor 50 that directs the oil to one or the other of the sections 29, 30 is interposed at the top of the shunt and of the bypassed portion, so that at the moment of recirculation, the flow of the secondary circuit is made to proceed via the shunt 30, while during the mixing the flow of the secondary hydraulic circuit is made to proceed via the portion 29 of the secondary circuit that was bypassed by the shunt 30.

The equipment further includes means for observing the presence of the base in the hardener at the top of the mixer and means preventing feeding to the mixer in the event that one of these products is missing.

The cycle proceeds as follows:

in the initial state, the valve $P_7$ of the recirculation circuit 54 is open, while all the other valves $P_1$–$P_6$ are closed;

next, the mixer 21 is put under pressure by opening of the valves $P_2$, $P_3$ for feeding the base 1 and hardener 2, while the other valves are closed;

then, the application begins by opening of the spray valve $P_1$; and as soon as the spray valve $P_1$ closes again during the preregulated period of time, the delay circuit triggers the rinsing cycle:

initially, via a decompression phase during which the valves $P_2$, $P_3$ for feeding the base and hardener and the spray valve $P_1$ are closed while the other valves $P_4$–$P_7$ are open, then a chemical rinse during which only the valves $P_4$, $P_5$ for feeding the cleaning agents and the recirculation valve $P_7$ are open.

The rinsing can then be repeated several times before a final rinsing, during which the valve $P_6$ for evacuation of the product contained in the mixer is additionally opened;

finally, the rinsing is ended by closure of the aforementioned valves, except for the recirculation valve $P_7$, in order to return to the initial state.

The chemical rinsing preferably proceeds over a short period of time, for example 5 seconds, followed by a period of soaking with the solvent, also on the order of 5 seconds, which is repeated several times, for example between one and a dozen times.

Advantageously, all the controlled valves are provided with a double control means, one mainly electric and the other pneumatic for an emergency.

The mixer 21 advantageously includes a first mixer 41 of the "spiral" type communicating with the products of the successive speedups and slowdowns that promote their mixing, at the outlet of which a flexible conduit 42 is connected for connection with a second mixer 43 of the static or "divider" type, which by dividing the output improves the mixture.

I claim:

1. A method for mixing and spraying a base liquid and a hardener for obtaining a fast-hardening product:

forcing the base liquid (1) contained in a first reservoir (7) into a first hydraulic circuit (4) leading to a nozzle (8) for spraying onto the ground (9), forcing the hardener contained in a second reservoir (27) into a second hydraulic circuit (24);

the first circuit (4) for the base liquid and the second circuit for the hardener being connected to a mixer (21) connected in turn to a spray nozzle (8) adapted to spray the mixture onto the surface under the control of a controlled valve ($P_1$);

adjusting the relative flow of the base liquid and the hardener to the mixer (4) to control the proportions of the mixture;

controlling the application of the output of the mixer (1) to the spray nozzle (8) to thereby control the product sprayed onto the surface, activating a circuit for providing an adjusted delay for a predetermined period of time between a zero value and a value at least slightly less than the hardening time of the hardener when air-sealed so as to cause a control signal to be emitted at the end of the predetermined period of time, interrupting the feeding of the base (1) and hardener (2) to the mixer (1) in response to the control signal, and initiating an evacuation and cleaning cycle including alternating phases of washing, using at least one solvent, and rinsing, during which cleaning cycle the hardener is returned to its reservoir by way of recirculation.

2. The method as defined by claim 1, further including:

synchronizing the first and the second hydraulic circuits for controlling the relative flow of the base liquid and hardener into said first and said second circuits, respectively, shunting a portion of the flow in the second hydraulic circuit and regulating the output of the second hydraulic circuit over at least one of the sections that forms this shunt for the shunted portion of the flow and the portion of the circuit bypassed by said shunt, such that in the shunt the output flow is less than in the portion of the circuit bypassed by said shunt, recirculating the flow of the second circuit and at the moment of recirculation the flow of the second circuit proceeds via the shunt, while during mixing of the base liquid and hardener the flow of the second circuit proceeds via the portion of the second circuit bypassed by the shunt.

3. The method as defined by claim 2 wherein the cleaning cycle includes phases of soaking the second circuit with solvent.

4. Apparatus for mixing a liquid (1) and a hardener (2) for obtaining a fast-hardening product comprising:

a first circuit (4) including first motor means (5) connected to drive at least one first pump (6) for forcing the liquid (1) contained in a first reservoir (7) into said circuit (4), a spray nozzle connected to receive the liquid, a valve ($P_1$) upstream of the nozzle (8) control means (35, 36) for interrupting a spray emitted from the nozzle circuits (35, 36);

a second circuit (24) including second motor means connected to drive a second pump (26) for forcing the hardener contained in a second reservoir (27) into the second circuit (24), a mixer 21 connected to the first and the second circuits to a mixer (21), said spray nozzle (8) being connected to the mixer (21) under the control of the control valve ($P_1$), means for adjusting the output of the first and second pumps (6, 26) to maintain the proportions of the mixture of the liquid (1) and the hardener (2), means for interrupting the spray output of the nozzle and triggering an evacuation and cleaning cycle, during which evacuation and cleaning cycle, the return of the hardener to its reservoir is recirculated, and further including a first hydraulic circuit (10) and a second hydraulic circuit (20), said first hydraulic circuit including said first motor means for driving said first pump, said second hydraulic circuit including said second motor means for driving said second pump, said first and second motors being hydraulic motors and said second hydraulic circuit having shunt across a section thereof for regulating the output of the second hydraulic circuit such that in the shunt (30) the flow will be less than in the section (29) of the circuit (20) bypassed by the shunt (30), and at the moment of recirculation the flow of the second hydraulic circuit proceeds via the shunt, while during the mixing of the liquid and hardener the flow of the second hydraulic circuit proceeds via the section (29) of the second hydraulic circuit bypassed by the shunt.

5. Apparatus as set forth in claim 4 including:

first valves ($P_2$, $P_3$) disposed in the first and second circuit at inlets to the mixer;

first circuit means connected to the mixer for feeding the products used in the various phases of the cleaning cycle, said circuits being disposed in communication with the mixer, downstream of the controlled valves ($P_2$, $P_3$);

said first circuit means including second controlled valves ($P_4$, $P_5$) for monitoring the arrival at the mixer of the cleaning products, a flow circuit connected to an outlet of the mixer for evacuation of the products contained in the mixer, a delay circuit connected to second circuit means including the controlled valves ($P_4$, $P_5$) for controlling the valve $P_1$ and monitoring the spraying, said delay circuit including delay means for adjustment between a zero period of time and a period of time at least slightly shorter than that necessary for hardening of the mixture in an air sealed manner and emitting a signal at the end of the period of time; and third circuit means responsive to the emitted signal for controlling the closing of the first valves ($P_2$, $P_3$) for controlling the flow of the liquid and hardener to the mixer and triggering a cycle of evacuation and cleaning including, in alternation, washing phases, using at least one solvent, and rinsing phases.

6. Apparatus as defined by claim 5, including:

a reservoir connected to the flow circuit for receiving evacuated solvent and hardener products, and a control monitoring valve ($P_6$) for monitoring the evacuation to the reservoir of the products contained in the mixer via the flow circuit.

7. Apparatus as defined by claim 5 including:

a recirculation conduit for the hardener, connected to the second circuit upstream of a control valve ($P_2$) for monitoring the arrival of the hardener at the mixer, said recirculation conduit being connected to a secondary reservoir for the hardener; and control valve means ($P_7$) interposed in the recirculation conduit for monitoring the return of the hardener to the secondary reservoir.

8. Apparatus as defined by claim 6 including:

a recirculation conduit for the hardener, connected to the second circuit upstream of one of the first valves ($P_2$) monitoring the arrival of the hardener at the mixer, said recirculation conduit being connected to the secondary reservoir of the hardener; and control valve means ($P_7$) interposed in the recirculation conduit for monitoring the return of the hardener to its reservoir.

9. Apparatus as defined by claim 8, including a shunt disposed over a portion of the second hydraulic circuit, an output regulator interposed over at least one of the sections which forms the shunt and the portion of the circuit bypassed by said shunt, such that in the shunt, the output flow is less than in the portion of the circuit bypassed by the shunt, and distributor means for directing oil to one or the other of the shunt or portion of the circuit bypassed by the shunt such that at the moment recirculation of flow, the flow of the secondary circuit proceeds via the shunt, while during the mixing the flow of the second hydraulic circuit proceeds via the portion of the secondary circuit bypassed by the shunt.

10. Apparatus as defined by claim 8 including a shunt disposed over a portion of the second hydraulic circuit, an output regulator interposed over at least one of the sections which forms the shunt and the portion of the circuit bypassed by said shunt, such that in the shunt, the output flow is less than in the portion of the circuit bypassed by the shunt, and distributor means for directing oil to one or the other of the shunt or portion of the circuit bypassed by the shunt such that at the moment recirculation of flow, the flow of the secondary circuit proceeds via the shunt, while during the mixing the flow of the second hydraulic circuit proceeds via the portion of the secondary circuit bypassed by the shunt.

11. Apparatus as defined by claim 5, wherein the mixer includes a first mixer of the "spiral" type, communicating with the products subject to successive speed-ups and slowdowns so as to promote mixture of the products, a flexible conduit at the outlet of the first mixer, a second mixer connected to the conduit, the second mixer being of the static or "divider" type.

* * * * *

UNITED STATES PATENT AND TRADEMARK OFFICE

CERTIFICATE OF CORRECTION

PATENT NO. : 5,126,173

DATED : June 30, 1992

INVENTOR(S) : Jean-Philippe Machenaud

It is certified that error appears in the above-identified patent and that said Letters Patent is hereby corrected as shown below:

Col. 8, line 28 (Claim 9, line 1) "claim 8" should be --claim 7--.

Signed and Sealed this

Twenty-third Day of November, 1993

*Attest:*

*Attesting Officer*

BRUCE LEHMAN

*Commissioner of Patents and Trademarks*